US012110887B2

(12) United States Patent
Liu et al.

(10) Patent No.: US 12,110,887 B2
(45) Date of Patent: Oct. 8, 2024

(54) FIXED SCROLL AND SCROLL COMPRESSOR

(71) Applicant: Copeland Climate Technologies (Suzhou) Co., Ltd., Jiangsu (CN)

(72) Inventors: Xuan Liu, Jiangsu (CN); Hong Yan, Jiangsu (CN); Hongwei Zou, Jiangsu (CN); Xinxian Liu, Jiangsu (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 0 days.

(21) Appl. No.: 18/006,088

(22) PCT Filed: Nov. 10, 2020

(86) PCT No.: PCT/CN2020/127716
§ 371 (c)(1),
(2) Date: Jan. 19, 2023

(87) PCT Pub. No.: WO2022/021665
PCT Pub. Date: Feb. 3, 2022

(65) Prior Publication Data

US 2023/0349381 A1 Nov. 2, 2023

(30) Foreign Application Priority Data

Jul. 27, 2020 (CN) ..... 202010731522.4
Jul. 27, 2020 (CN) ..... 202021507746.9

(51) Int. Cl.
*F04C 18/02* (2006.01)
*F04C 29/12* (2006.01)

(52) U.S. Cl.
CPC ..... *F04C 18/0292* (2013.01); *F04C 18/0215* (2013.01); *F04C 29/12* (2013.01); *F04C 2250/101* (2013.01)

(58) Field of Classification Search
CPC .. F04C 18/0292; F04C 18/0215; F04C 29/12; F04C 2250/101; F04C 18/0253; F04C 18/0269
(Continued)

(56) References Cited

U.S. PATENT DOCUMENTS 6,364,643 B1 4/2002 Milliff
2004/0101428 A1* 5/2004 Shibamoto ..... F04C 18/0269 418/55.2
(Continued)

FOREIGN PATENT DOCUMENTS

CN 202628514 U 12/2012
CN 203321824 U 12/2013
(Continued)

OTHER PUBLICATIONS

International Search Report issued in PCT/CN2020/127716, mailed on Apr. 25, 2021; pp. 1-11.
(Continued)

*Primary Examiner* — J. Todd Newton
(74) *Attorney, Agent, or Firm* — Armstrong Teasdale LLP

(57) ABSTRACT

Disclosed are a fixed scroll and a scroll compressor. The fixed scroll comprises a fixed scroll end plate, a fixed scroll wrap, and a peripheral wall, wherein an air inlet is provided in the peripheral wall, the fixed scroll wrap comprises a starting end connected to the peripheral wall, an engagement position to be engaged with an orbiting scroll wrap, and a scroll section extending from the starting end to the engagement position; the fixed scroll further comprises a flow-guiding passage in fluid communication with the air inlet; the flow-guiding passage extends from the starting end and extends along at least part of the scroll section; the scroll section comprises a first side wall comprising a first section having a first center of curvature and a second section having
(Continued)

a second center of curvature, which are respectively located on radially opposite sides of the first side wall.

19 Claims, 11 Drawing Sheets

(58) Field of Classification Search
USPC ..... 418/55.1
See application file for complete search history.

(56) References Cited

U.S. PATENT DOCUMENTS

| | | | | |
|---|---|---|---|---|
| 2006/0222545 | A1 | 10/2006 | Nam et al. | |
| 2006/0222546 | A1 | 10/2006 | Lee et al. | |
| 2019/0072092 | A1* | 3/2019 | Kim | F04C 18/0215 |

FOREIGN PATENT DOCUMENTS

| | | | |
|---|---|---|---|
| CN | 103502646 | A | 1/2014 |
| CN | 204646671 | U | 9/2015 |
| EP | 2703648 | A1 | 12/2011 |
| EP | 29933500 | A1 | 3/2016 |
| GB | 2370075 | A | 6/2002 |
| JP | 2010127209 | A | 6/2010 |
| JP | 2012031768 | A | 2/2012 |

OTHER PUBLICATIONS

European Extended Search Report issued in European Application No. 20946875.0 dated Jul. 25, 2024, pp. 1-12.

* cited by examiner

FIXED SCROLL AND SCROLL COMPRESSOR

This application is a U.S. National Stage Entry of International Patent Application No. PCT/CN2020/127716, filed Nov. 10, 2020, which claims priorities to the following two Chinese patent applications: Chinese Patent Application No. 202010731522.4 titled "FIXED SCROLL AND SCROLL COMPRESSOR", filed with the China National Intellectual Property Administration on Jul. 27, 2020; and Chinese Patent Application No. 202021507746.9, titled "FIXED SCROLL AND SCROLL COMPRESSOR", filed with the China National Intellectual Property Administration on Jul. 27, 2020. These applications are incorporated herein by reference in their entirety.

FIELD

The present application relates to the technical field of compressors, and in particular to a fixed scroll and a scroll compressor including the same.

BACKGROUND

This section only provides background information relating to the present application, which may not necessarily constitute the prior art.

A compressor (such as a scroll compressor) may be applied in, for example, a refrigeration system, an air conditioning system, and a heat pump system. The scroll compressor includes a compression mechanism which includes a non-orbiting scroll and an orbiting scroll, the non-orbiting scroll and the orbiting scroll are engaged with each other to define an open suction cavity and a series of closed compression cavities. In addition, for a low-pressure side scroll compressor, an air inlet is generally defined in a peripheral wall of the non-orbiting scroll, the air inlet is communicated to the suction cavity, and a refrigerant enters the suction cavity through the air inlet and is supplied to the series of closed compression cavities inside the compression mechanism to compress the refrigerant.

However, in the scroll compressor of the conventional technology, the refrigerant may produce turbulence or vortex and velocity gradient when it enters the suction cavity through the air inlet, which may cause pressure loss, reduce the enthalpy difference of the refrigerant, and thus reduce the refrigeration efficiency of the scroll compressor. Therefore, it is necessary to further improve the scroll compressor, so as to improve the utilization efficiency of the refrigerant and thus improve the refrigeration efficiency of the scroll compressor.

SUMMARY

A general summary of the present application, rather than a full scope or a full disclosure of all features of the present application, is provided in this section.

An object of the present application is to improve one or more technical problems mentioned above. In general, a non-orbiting scroll and a scroll compressor including the non-orbiting scroll as described below are provided according to the present application, which can optimize the flow guiding of a refrigerant into a compression mechanism, thereby significantly reducing the pressure loss and enthalpy difference of the refrigerant, and thus improving the refrigeration efficiency of the scroll compressor.

According to one aspect of the present application, a non-orbiting scroll of a scroll compressor is provided, which includes:

a non-orbiting scroll end plate;

a non-orbiting scroll wrap extending from a first side surface of the non-orbiting scroll end plate; and a peripheral wall extending from the first side surface, located radially outside the non-orbiting scroll wrap and surrounding the non-orbiting scroll wrap, wherein an air inlet is provided in the peripheral wall, the non-orbiting scroll wrap includes a starting end connected to the peripheral wall and an engagement position to be engaged with a radial outermost tail end of an orbiting scroll wrap of an orbiting scroll of the scroll compressor, and the non-orbiting scroll wrap includes a wrap section extending from the starting end to the engagement position, characterized in that the non-orbiting scroll further includes a flow-guiding passage in fluid communication with the air inlet, the flow-guiding passage extends from the starting end and extends along at least a part of the wrap section, the wrap section includes a first side wall located in the flow-guiding passage, the first side surface includes a first section extending from the starting end and having a first curvature center and a second section extending from the first section and having a second curvature center, and the first curvature center and the second curvature center are respectively located on radially opposite sides of the first side wall.

The above two-stage design with different curved directions is specially designed for the flow of the refrigerant in the flow-guiding passage, which can significantly reduce the turbulence and pressure loss of the refrigerant, thereby providing better flow-guiding effect for the refrigerant.

According to a preferred embodiment of the present application, the first section extends from the starting end to about ⅕ to ⅔ of a length of the first side wall, and a curvature change value of the first section is larger than a curvature change value of the second section, which has a better inhibition effect on turbulence and can reduce the pressure loss of the refrigerant.

According to a preferred embodiment of the present application, in the flow-guiding passage, a largest curvature is defined at the starting end.

According to a preferred embodiment of the present application, a distance between the peripheral wall and the non-orbiting scroll wrap at the engagement position is a first radial width Xm, the starting end is formed as a filleted corner, and a radius of curvature Rc of the filleted corner satisfies: $2\ \text{mm} \leq Rc \leq 0.4Xm$.

The starting end with the filleted corner with such curvature is combined with the first side wall and the second side wall of the above streamlined design, so that the refrigerant does not form vortex at the starting end when it enters the flow-guiding passage through the air inlet, and can significantly reduce the turbulence in the flow-guiding passage, thereby reducing the pressure gradient of the refrigerant in the flow-guiding passage, reducing the pressure loss, and thus improving the refrigeration efficiency of the scroll compressor.

According to a preferred embodiment of the present application, along a direction from the engagement position to the starting end, a first radial thickness of a flow-guiding wrap section, defining the flow-guiding passage, of the wrap section increases progressively, and the first radial thickness is larger than or equal to a second radial thickness of the non-orbiting scroll wrap at the engagement position and is smaller than or equal to 3 times of the second radial thickness.

According to a preferred embodiment of the present application, the flow-guiding passage includes a recessed portion recessed relative to the first side surface, the recessed portion includes a recessed bottom wall, and a recessed depth L of the recessed bottom wall relative to the first side surface satisfies: $L \leq 0.3H$, in which H is an axial height of the non-orbiting scroll wrap. An internal volume and a related flow-guiding effect of the flow-guiding passage can be better adjusted by further adjusting the depth of the flow-guiding passage along an axial direction of the non-orbiting scroll.

According to a preferred embodiment of the present application, the recessed depth increases toward the starting end. Thus, the refrigerant can be smoothly guided into the subsequent suction cavity, which is beneficial to reducing the formation of turbulence and vortex, and can reduce the pressure gradient of the refrigerant in different areas of the flow-guiding passage.

According to a preferred embodiment of the present application, the recessed bottom wall includes an inclined surface, a horizontal surface, a curved surface or a combination thereof.

According to a preferred embodiment of the present application, a distance between the peripheral wall and the non-orbiting scroll wrap at the engagement position is a first radial width Xm, a third radial width K of the recessed portion satisfies: $0.7Xm \leq K < Xm$, the flow-guiding passage has a second radial width, the third radial width of at least a part of the recessed portion is smaller than the second radial width of the flow-guiding passage at a corresponding position along an extending direction of the non-orbiting scroll wrap to form a step portion on the first side surface.

According to a preferred embodiment of the present application, a recessed angle of the recessed bottom wall relative to the first side surface is less than or equal to 70°.

According to a preferred embodiment of the present application, at least one ventilation opening is provided in the peripheral wall, so that refrigerant can enter the flow-guiding passage through the at least one ventilation opening.

According to a preferred embodiment of the present application, the peripheral wall includes a bridging portion located at an axial tail end of the peripheral wall and adjacent to the air inlet, and the at least one ventilation opening is provided at the bridging portion.

With this branched flow path, the possible turbulence or vortex in the flow-guiding passage can be dispersed, and the pressure gradient in areas of the flow-guiding passage can be balanced, which improves the refrigeration efficiency of the scroll compressor.

According to a preferred embodiment of the present application, a circumferential side of the air inlet is substantially flush with the starting end.

According to another aspect of the present application, a scroll compressor is provided, which includes the non-orbiting scroll as described above.

In summary, at least the following beneficial technical effects are provided by the non-orbiting scroll and the scroll compressor according to the present application: the non-orbiting scroll and the scroll compressor according to the present application can optimize the flow guiding of the refrigerant into the compression mechanism by providing the flow-guiding passage and the ventilation opening with the above structure, thereby significantly reducing the pressure loss and enthalpy difference of the refrigerant, thus improving the refrigeration efficiency of the scroll compressor, which has high cost efficiency due to the simple structure and easy processing and manufacturing.

BRIEF DESCRIPTION OF THE DRAWINGS

The foregoing and additional features and characteristics of the present application will become clearer from the following detailed description with reference to the accompanying drawings, which are merely examples and are not necessarily drawn to scale. Same reference numerals in the drawings indicate same parts. In the drawings.

Figure 1:
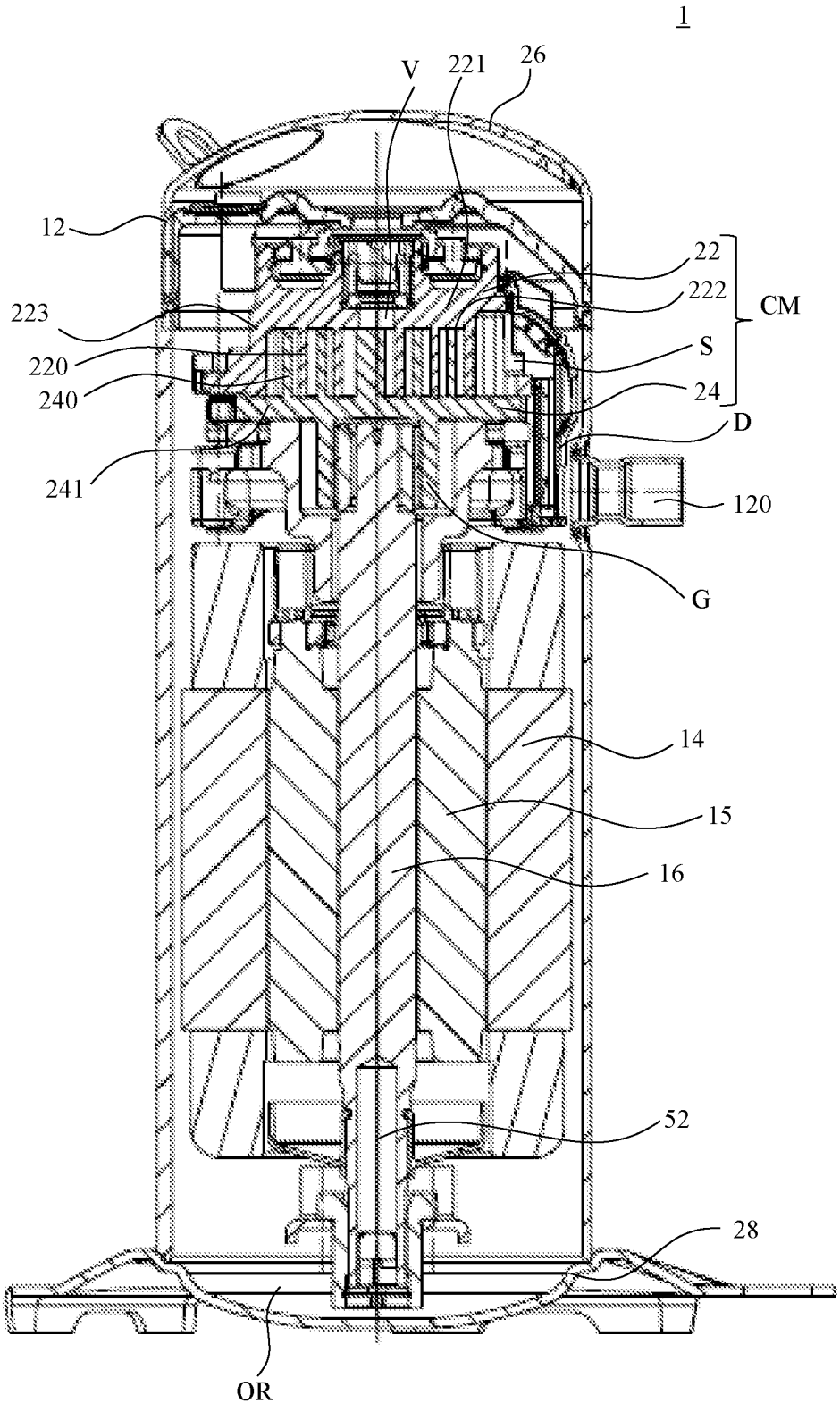
FIG. 1 is a longitudinal cross-sectional view of a scroll compressor according to the present application.

Reference numerals are as follows:

| | |
|---|---|
| 1, scroll compressor; | 12, housing; |
| 14, stator; | 15, rotor; |
| 16, drive shaft; | 11, main bearing housing |
| 24, orbiting scroll; | 22, non-orbiting scroll; |
| 26, cover; | 28, seat; |
| OR, oil poor; | 52, central hole |
| G, hub; | CM, compression mechanism; |
| 221, non-orbiting scroll end plate; | 220, non-orbiting scroll wrap; |
| V, exhaust port | |
| 241, orbiting scroll end plate; | 240, orbiting scroll wrap; |
| G, hub; | 223, peripheral wall; |
| S, air inlet | |
| 120, refrigerant inlet; | D, air inlet cover; |
| Q, bridging portion; | P, flow-guiding passage; |
| W1, first side wall | |
| W2, second side wall; | C, starting end; |
| A, engagement position; | X, second radial width; |
| Xm, first radial width | |
| W11, first section; | W12, second section; |
| B, point; | X', radial width of bottom; |
| S10, outer edge | |

-continued

| | |
|---|---|
| Y, first radial thickness; | Ym, second radial thickness; |
| Rc, radius of curvature of filleted corner; | P1, recessed portion |
| P10, recessed bottom wall; | L, recessed depth; |
| H, axial height of non-orbiting scroll wrap; | P12, inclined surface section |
| P14, horizontal surface section; | K, third radial width; |
| T, step portion; | G, recessed angle |
| Q10, Q20, Q30, ventilation opening; | P20, flow-guiding wrap section. |

DETAILED DESCRIPTION OF EMBODIMENTS

Preferred embodiments of the present application will be described in detail hereinafter in conjunction with FIGS. 1 to 11. The following description is merely exemplary in nature and is not intended to limit the present application and an application or use thereof.

In the following exemplary embodiments, the scroll compressor is exemplarily shown as a vertical scroll compressor. However, the scroll compressor according to the present application is not limited to this type, but can be any suitable type of scroll compressor, such as a horizontal scroll compressor.

Figure 2A:
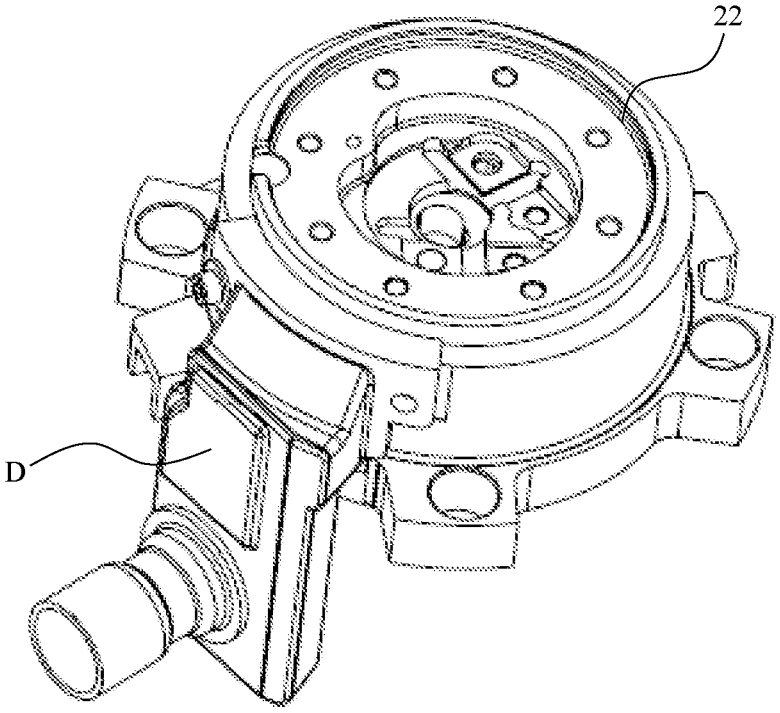
FIG. 2*a* is a perspective view of a non-orbiting scroll in FIG. 1, which shows an air inlet cover mounted at an air inlet of the non-orbiting scroll.
Figure 2B:
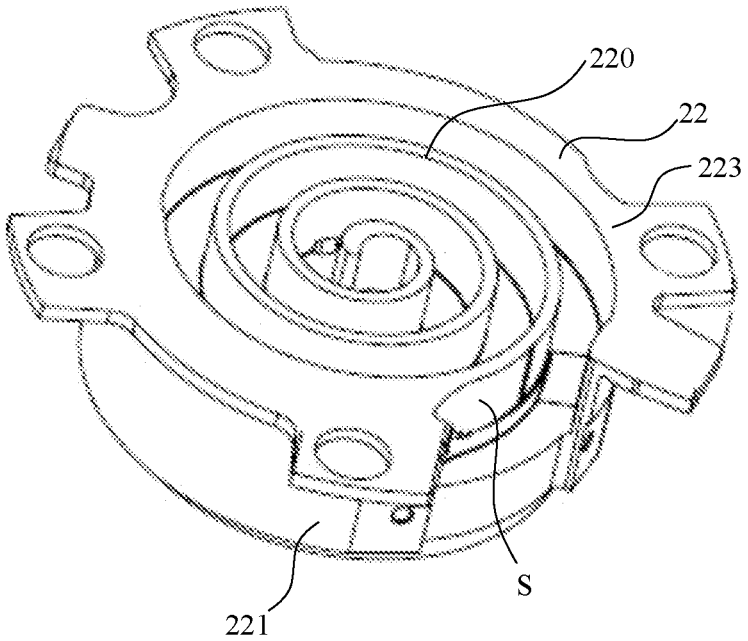
FIG. 2*b* is a perspective view of the non-orbiting scroll in FIG. 2*a* viewed from another perspective, in which the air inlet cover is removed to show the air inlet of the non-orbiting scroll.
Figure 2C:
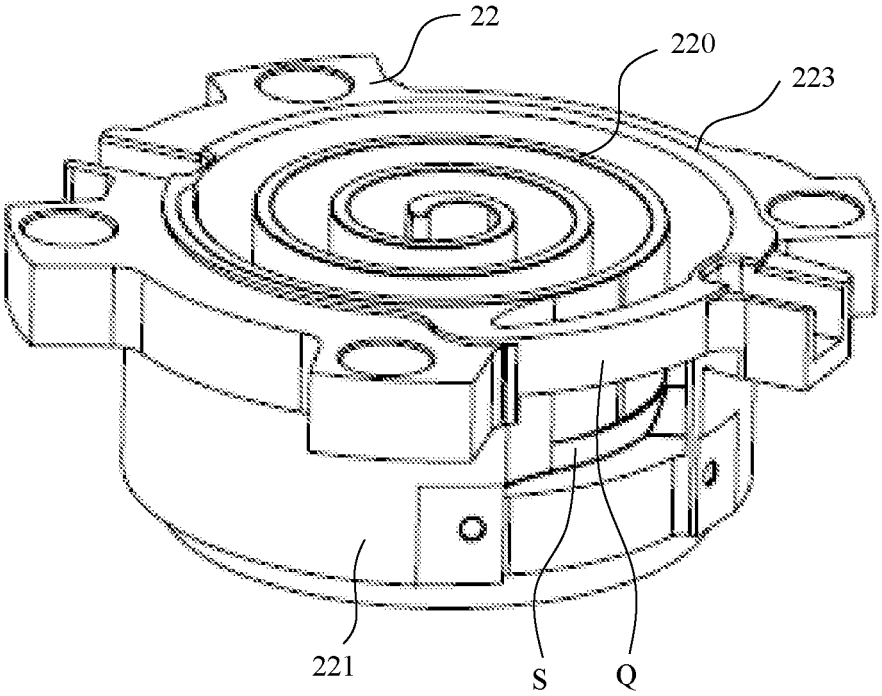
FIG. 2*c* shows another configuration of the air inlet of the non-orbiting scroll of the scroll compressor according to the present application.

FIG. 1 is a longitudinal cross-sectional view of a scroll compressor according to the present application; FIG. 2*a* is a perspective view of a non-orbiting scroll 1 in FIG. 1, which shows an air inlet cover D mounted at an air inlet S of the non-orbiting scroll 22; FIG. 2*b* is a perspective view of the non-orbiting scroll 22 in FIG. 2*a* viewed from another perspective, in which the air inlet cover D is removed to show the air inlet S of the non-orbiting scroll 22; and FIG. 2*c* shows another configuration of the air inlet S of the non-orbiting scroll 22 of the scroll compressor 1 according to the present application. Firstly, an overall structure of the scroll compressor 1 is briefly described with reference to FIGS. 1 to 2*c*.

As shown in FIG. 1, the scroll compressor 1 may include a substantially cylindrical housing 12, an electric motor (includes a stator 14 and a rotor 15), a drive shaft 16, a main bearing housing 11, an orbiting scroll 24 and a non-orbiting scroll 22.

A cover 26 at the top of the housing 12 and a seat 28 located at the bottom of the housing 12 may be mounted to the housing 12, so as to define an internal volume of the scroll compressor 1. A lubricant, such as lubricating oil can be stored in an oil pool OR at the bottom of the housing 12 to lubricate various components of the scroll compressor 1.

The electric motor includes a stator 14 and a rotor 15. The rotor 15 is used to drive the drive shaft 16, so as to rotate the drive shaft 16 about its rotation axis relative to the housing 12. The drive shaft 16 may include an eccentric pin, which is mounted to a first end (a top end) of the drive shaft 16 or is integrally formed with the first end of the drive shaft 16. The drive shaft 16 may further include a central hole 52 and an eccentric hole (not shown), the central hole 52 is formed at a second end (a bottom end) of the drive shaft 16, and the eccentric hole extends upward from the central hole 52 to an end surface of the eccentric pin. An end (a lower end) of the central hole 52 can be immersed in the oil pool OR at the bottom of the housing 12 of the scroll compressor 1, so that for example, under the centrifugal force generated by the rotation of the drive shaft 16, the lubricating oil can be conveyed from the oil pool OR at the bottom of the housing 12, and the lubricating oil can flow upward through the central hole 52 and the eccentric hole and flow out from the end surface of the eccentric pin. The lubricating oil flowing out from the end surface of the eccentric pin can flow to lubricating oil supply zones, for example, formed between the eccentric pin and the orbiting scroll 24 and between the main bearing housing 11 and the orbiting scroll 24. The lubricating oil in the lubricating oil supply zones can lubricate rotating joints and sliding surfaces, for example, between the eccentric pin and the orbiting scroll 24 and between the main bearing housing 11 and the orbiting scroll 24.

The non-orbiting scroll 22 is mounted to the main bearing housing 11, for example, by using mechanical fasteners such as screw fastening members. The orbiting scroll 24 is axially supported by the main bearing housing 11 and is capable of orbiting supported by the main bearing housing 11. Specifically, a hub G of the orbiting scroll 24 can be rotatably connected to the eccentric pin of the drive shaft 16, the orbiting scroll 24 is driven by the electric motor via the drive shaft 16 (specifically the eccentric pin), so as to be able to perform translational rotation relative to the non-orbiting scroll 22 with the help of an Oldham ring, that is, the orbiting motion (that is, an axis of the orbiting scroll 24 orbits about an axis of the non-orbiting scroll 22, but the orbiting scroll 24 and the non-orbiting scroll 22 themselves do not rotate around their respective axes).

The orbiting scroll 24 and the non-orbiting scroll 22 form a compression mechanism CM suitable for compressing a working fluid (such as a refrigerant), in which the non-orbiting scroll 22 includes a non-orbiting scroll end plate 221, a non-orbiting scroll wrap 220 and an exhaust port V located at the center of the non-orbiting scroll 22; the orbiting scroll 24 includes an orbiting scroll end plate 241, an orbiting scroll wrap 240 and the hub G, and the compression mechanism CM includes an air inlet S (two configurations of the air inlet S are shown in FIG. 2*b* and FIG. 2*c*) located in a peripheral wall 223 of the non-orbiting scroll 22, an open suction cavity defined by the non-orbiting scroll 22 and the orbiting scroll 24, and a series of closed compression cavities for compressing the working fluid (such as the refrigerant), in which, the air inlet S is in fluid communication with the suction cavity and in fluid communication with a refrigerant source outside the compression mechanism CM, so that the refrigerant from the refrigerant source is supplied to the suction cavity and the series of closed compression cavities of the compression mechanism CM through the air inlet S to be compressed, and the compressed refrigerant is discharged from the exhaust port V at the center of the non-orbiting scroll 22 to an exterior of the compression mechanism CM.

As for the refrigerant source, as shown in FIG. 1, a refrigerant inlet 120 is provided on one side of the housing 12 of the scroll compressor 1, and the scroll compressor 1 shown in FIG. 1 includes an air inlet cover D extending from the refrigerant inlet 120 to the air inlet S of the non-orbiting scroll 22. In the perspective views of the non-orbiting scroll 22 as shown in FIG. 2*a* and FIG. 2*b*, the air inlet S of the non-orbiting scroll 22 and the air inlet cover D mounted at the air inlet S are clearly shown. The air inlet cover D can play the role of conveying and guiding the refrigerant, so that the refrigerant can directly flow into the air inlet S through the refrigerant inlet 120, so as to prevent the refrigerant from staying in the environment inside the housing 12 and outside the compression mechanism CM, and reducing the enthalpy difference due to heat absorption, which improves the refrigeration efficiency of the scroll compressor 1. However, it should be understood that although the following embodiments of the present application and the accompanying drawings are described with the scroll compressor 1 with the air inlet cover D as an example, the configuration of the present application is not limited to this, but is also applicable to the scroll compressor without the air inlet cover D.

In addition, as shown in FIG. 2*b*, the air inlet S is an opening defined in the peripheral wall 223 of the non-orbiting scroll 22, and the air inlet S extends upward from the bottom of the peripheral wall 223 to the top of the peripheral wall 223 along an axial direction of the non-orbiting scroll 22. However, the present application is not limited thereto, FIG. 2*c* shows another configuration of the air inlet S of the non-orbiting scroll 22 of the scroll compressor 1 according to the application. As shown in FIG. 2*c*, compared with the configuration in FIG. 2*b*, the air inlet S does not extend upward to the top of the peripheral wall 223, but a part of the peripheral wall 223 is remained above the air inlet S to form a bridging portion Q. The two configurations of the air inlet S will be involved in the following specific embodiments and described in further detail.

As described above, in the conventional technology, the refrigerant may produce turbulence or vortex and velocity gradient when it enters the suction cavity of the compression mechanism through the air inlet, which may cause pressure loss, reduce the enthalpy difference of the refrigerant, and thus reduce the refrigeration efficiency of the scroll compressor. In order to solve the above problems, the present application improves the non-orbiting scroll 22 of the scroll compressor 1. Specifically, a flow-guiding passage P is designed between the air inlet S and the suction cavity, and a streamlined design and designs for preventing turbulence, vortex and pressure loss are applied to the flow-guiding passage P, so as to significantly improve the refrigeration efficiency of the scroll compressor.

The preferred embodiments of the non-orbiting scroll 22 of the scroll compressor 1 according to the present application will be described in detail with reference to FIGS. 3 to 11 to specifically describe the optimal design of all aspects of the flow-guiding passage P.

Figure 3:
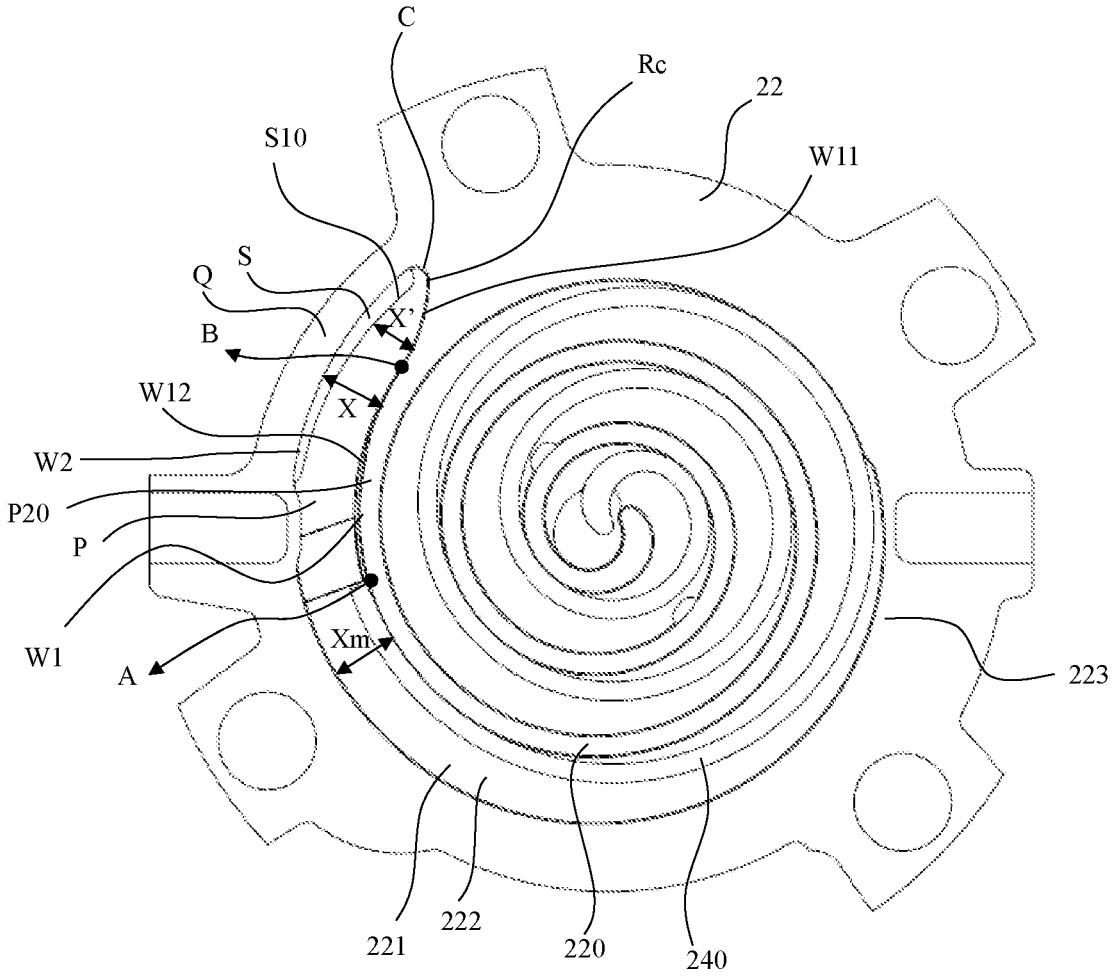
FIG. 3 is a plan view of the non-orbiting scroll according to a first embodiment of the present application, which schematically shows an engagement between a non-orbiting scroll wrap and an orbiting scroll wrap.
Figure 4:
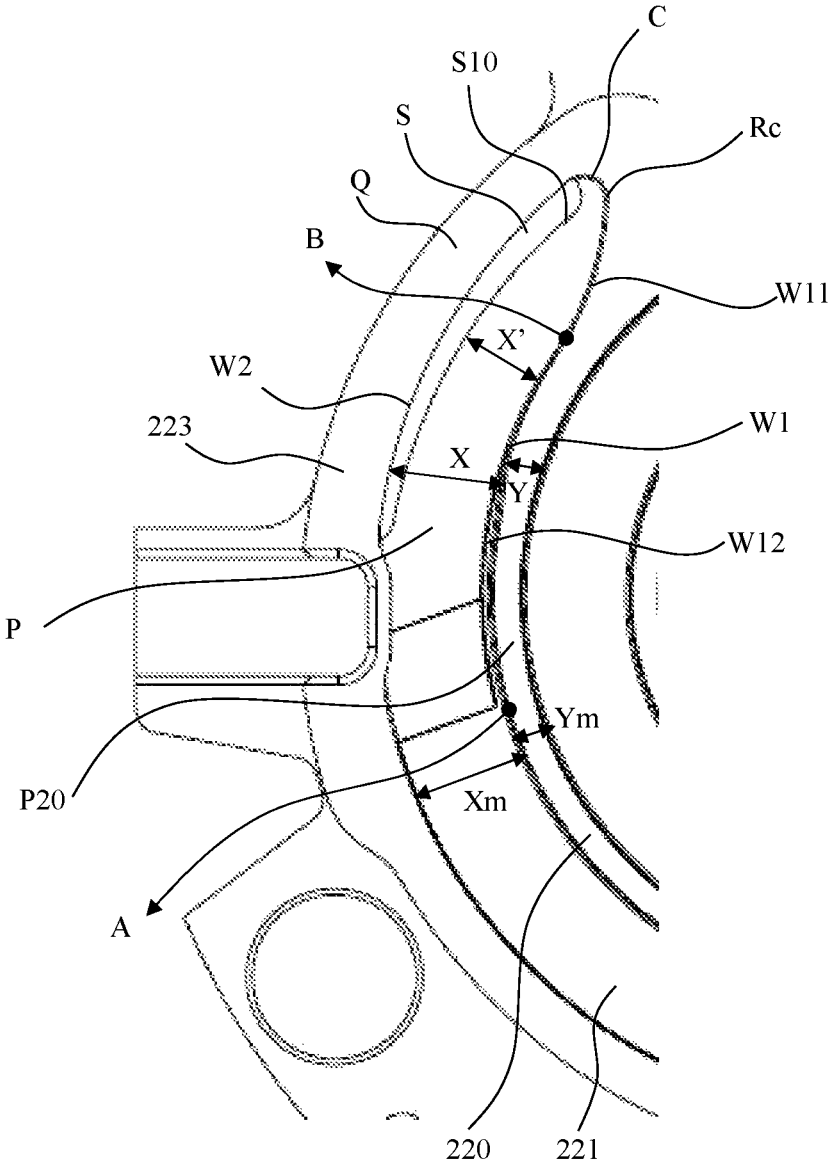
FIG. 4 is a partial enlarged view of the non-orbiting scroll in FIG. 3.

FIG. 3 is a plan view of the non-orbiting scroll 22 according to a first embodiment of the present application, which schematically shows an engagement between the non-orbiting scroll wrap 220 and the orbiting scroll wrap 240; and FIG. 4 is a partial enlarged view of the non-orbiting scroll 22 in FIG. 3, and the orbiting scroll wrap 240 is removed.

As shown in FIG. 3, the non-orbiting scroll 22 includes: the non-orbiting scroll end plate 221; the non-orbiting scroll wrap 220, extending from a first side surface 222 of the non-orbiting scroll end plate 221; and the peripheral wall 223, extending from the first side surface 222 of the non-orbiting scroll end plate 221, and surrounding the non-orbiting scroll wrap 220 on a radial outer side of the non-orbiting scroll wrap 220, the non-orbiting scroll 22 further includes a flow-guiding passage P located in a space defined by the non-orbiting scroll wrap 220, the non-orbiting scroll end plate 221 and the peripheral wall 223, the flow-guiding passage P extends from a starting end C, connected to the peripheral wall 223, of the non-orbiting scroll wrap 220, and extends along at least a part of a wrap section of the non-orbiting scroll wrap 220, the wrap section extends from the starting end C to an engagement position A to be engaged with a radial outermost tail end of the orbiting scroll wrap 240 of the orbiting scroll 24 of the scroll compressor 1, the air inlet S is defined in the peripheral wall 223, and the flow-guiding passage P is in fluid communication with the air inlet S. In this embodiment, the air inlet S of the peripheral wall 223 has the configuration as shown in FIG. 2*c*, and the bridging portion Q located above the air inlet S is shown in FIG. 3 and FIG. 4.

In this embodiment, preferably, the flow-guiding passage P extends from the starting end C to the engagement position A, and two inner side walls of the flow-guiding passage P are a first side wall W1 located on the non-orbiting scroll wrap 220 and a second side wall W2 located on the peripheral wall 223, the first side wall W1 and the second side wall W2 (including the bridging portion Q) converge from the engagement position A to the starting end C, that is, a second radial width X of the flow-guiding passage P defined by the first side wall W1 and the second side wall W2 (including the bridging portion Q) integrally decreases from the engagement position A toward the starting end C. It should be noted that this is not limited to the case that the second radial width X always progressively decreases from the engagement position A to the starting end C (which will be detailed below), and the second radial width X of the flow-guiding passage P is smaller than a first radial width Xm of an adjacent section adjacent to the flow-guiding passage P, that is, an extension section from the engagement position A in FIG. 3 and FIG. 4 and including the engagement position A. In addition, the first side wall W1 includes a first section W11 extending from the starting end C and a remaining second section W12, a first curvature center of the first section W11 and a second curvature center of the second section W12 are respectively located on radially opposite sides of a flow-guiding wrap section P20 (or the first side wall W1) located in an extension range of the flow-guiding passage P of the non-orbiting scroll wrap 220, that is, as shown in FIG. 3 and FIG. 4, the first section W11 and the second section W12 take a position of point B as the boundary, the first section W11 and the second section W12 on two sides of point B are curved in opposite directions as shown in the figure, and a curvature change value of the first section W11 is larger than a curvature change value of the second section W12, that is, the first section W11 integrally has a smaller radius of curvature than the second section W12.

It can be seen that the first section W11 and the second section W112 are curved in opposite directions as shown in the figure, and the curvature change value of the first section W11 is larger than the curvature change value of the second section W12. Therefore, although the second radial width X of the flow-guiding passage P integrally decreases from the engagement position A to the starting end C, the second radial width X does not always progressively decrease from the engagement position A to the starting end C. According to the different design of the streamline curved radian of the first side wall W1 and the second side wall W2 of the flow-guiding passage P in practical application, the value of the second radial width X of the flow-guiding passage P may fluctuate locally, for example, especially near point B, but may not always progressively decrease.

However, in the first embodiment, the second radial width X progressively decreases from the engagement position A to the starting end C to form a smooth and gradual streamline, which reduces the flow resistance of the refrigerant and the pressure gradient of the refrigerant. In addition, the above two-stage design with different curved directions and different curvature is specially designed for the flow of the refrigerant in the flow-guiding passage P, which can significantly reduce the turbulence and pressure loss of the refrigerant, thus providing better flow-guiding effect for the refrigerant.

It should be noted here that, as described above, in this embodiment, the air inlet S in the peripheral wall 223 has the configuration in FIG. 2*c* as described above, and as shown in FIG. 3 and FIG. 4, the peripheral wall 223 includes a bridging portion Q located above the air inlet S, and the bridging portion Q may guide the flow of refrigerant. Therefore, the second radial width X of the flow-guiding passage P as described above mainly refers to the second radial width X defined by the first side wall W1 and the second side wall W2 (including a side wall of a section of the bridging portion Q). However, it should be understood that the second radial width X of the flow-guiding passage P as described above also covers a radial width X' of the bottom of the flow-guiding passage P which is adjacent to the air inlet S and is defined by an outer edge S10 of the bottom of the flow-guiding passage P and the first side wall W1. Specifically, as shown in FIG. 3 and FIG. 4, in order to provide more flow-guiding space for the flow of the refrigerant, the second side wall W2 on an inner side of the bridging portion Q expands radially outward, that is, when looking down from the first side surface 222 of the non-orbiting scroll end plate 221 of the non-orbiting scroll 22 shown in FIG. 3 and FIG. 4, the outer edge S10 at the bottom of the flow-guiding passage P can be seen through the second side wall W2 on the inner side of the bridging portion Q, that is, a part of the air inlet S can be seen, that is, the second radial width X defined by the first side wall W1 and the second side wall W2 is slightly larger than the radial width X' of the bottom of the flow-guiding passage P. The design of the radial width X' can be similar to the design of the second radial width X defined by the second side wall W1 and the second side wall W2, that is, the radial width X' of the bottom of the flow-guiding passage P is smaller than the first radial width Xm of the adjacent section, and preferably, the radial width X' decrease or progressively decrease from the engagement position A to the starting end C. It should be understood that the above design is also applicable to the air inlet S which does not include the configuration of the bridging portion Q, as shown in FIG. 2*b*.

More preferably, with regard to the first section W11 and the second section W12 taking the position of point B as the boundary, the position of point B can be adjusted according to the actual application requirements to adjust the flow of the refrigerant, for example, according to the different requirements of an intake volume, a flow rate and a pressure of the refrigerant, point B can be located at a position extending from the starting end C to about ⅕ to ⅔ of a length of the first side wall W1, that is, the first section W11 accounts for about ⅕ to ⅔ of the length of the first side wall W1. Preferably, in this embodiment, point B can be located at a position from the starting end C to about ⅓ of the length of the first side wall W1, that is, the first section W11 accounts for about ⅓ of the length of the first side wall W1, and the second section W12 accounts for about ⅔ of the length of the first side wall W1, which has a better inhibition effect on turbulence and can reduce the pressure loss of the refrigerant.

In addition, based on the above streamlined design of the first side wall W1, a first radial thickness Y of the flow-guiding wrap section P20 at the flow-guiding passage P increases from the engagement position A to the starting end C, and the first radial thickness Y satisfies: $Ym \leq Y \leq 3Ym$, where Ym represents a second radial thickness of the non-orbiting scroll wrap 220 at the above adjacent section (including the engagement position A) adjacent to the flow-guiding passage P.

In addition, preferably, as shown in FIG. 3 and FIG. 4, in the flow-guiding passage P, the starting end C has a maximum curvature, that is, has a minimum radius of curvature, and more preferably, the starting end C is formed as filleted corner, and a radius of curvature Rc of the filleted corner satisfies: $2\ mm \leq Rc \leq 0.4Xm$, where Xm represents the above first radial width. The starting end C with the filleted corner with such radius of curvature is combined with the first side wall W1 and the second side wall W2 of the above streamlined design, so that the refrigerant does not form vortex at the starting end C when it enters the flow-guiding passage P through the air inlet S as shown in FIG. 2*c*, FIG. 3 and FIG. 4, which can significantly reduce the turbulence in the flow-guiding passage P, thereby reducing the pressure gradient of the refrigerant in the flow-guiding passage P and reducing the pressure loss, thus improving the refrigeration efficiency of the scroll compressor 1. In addition, it should be noted that although in the preferred embodiments shown in the figures, a side of the air inlet S transverse to an air inlet direction of the air inlet S is flush with the starting end C, the present application is not limited thereto. In practical application, the air inlet S can also be arranged far away from the starting end C, that is, the side of the air inlet S transverse to the air inlet direction is not flush with the starting end C and has a certain distance from the starting end C. Even in this case, since the filleted corner at the starting end C and its radius of curvature are specially designed in this application in combination with the first side wall W1 and the second side wall W2 with the above streamline design, the formation of vortex or turbulence in the flow-guiding passage P, especially at the filleted corner of the starting end C can be avoided or improved. Certainly, preferably, as in the preferred embodiments of the present application, arranging the air inlet S such that the side of the air inlet S transverse to the air inlet direction is flush with the starting end C can best avoid vortex or turbulence.

In addition, it should be pointed out that although in the above embodiments and the embodiments described below, the flow-guiding passage P extends from the starting end C to the engagement position A, as described above, the flow-guiding passage P can also be limited to extending only along a part of the wrap section from the starting end C to the engagement position A of the non-orbiting scroll wrap 220. That is to say, although in the specific embodiment herein, the flow-guiding passage P extends from the starting end C to the engagement position A, and the engagement position A is used to describe the relevant features in the flow-guiding passage P, it should be clear that all relevant features described herein about the flow-guiding passage P, such as the corresponding proportional value, etc., are limited by an extension range of the flow-guiding passage P itself, that is, compared with the case where the flow-guiding passage P extends from the starting end C to the engagement position A, when the flow-guiding passage P only extends along a part of the wrap section from the starting end C to the engagement position A of the non-orbiting scroll wrap 220 and does not extend to the engagement position A, some features that may originally be located at, adjacent to or extended to the engagement position A may be also far away from the engagement position A.

In the above embodiments, the curved directions and streamline design of the two side walls of the flow-guiding passage P and the adjustment of the width of the flow-guiding passage P are mainly adopted to realize the optimal flow-guiding effect for the refrigerant. However, the present application is not limited thereto, and the internal volume and related flow-guiding effect of the flow-guiding passage P can be better adjusted by further adjusting the depth of the flow-guiding passage P along the axial direction of the non-orbiting scroll 22, for example, FIGS. 5 to 8 show the non-orbiting scroll 22 according to a second embodiment of the present application, and the second embodiment will be described in detail in combination with FIGS. 5 to 8.

Figure 5:
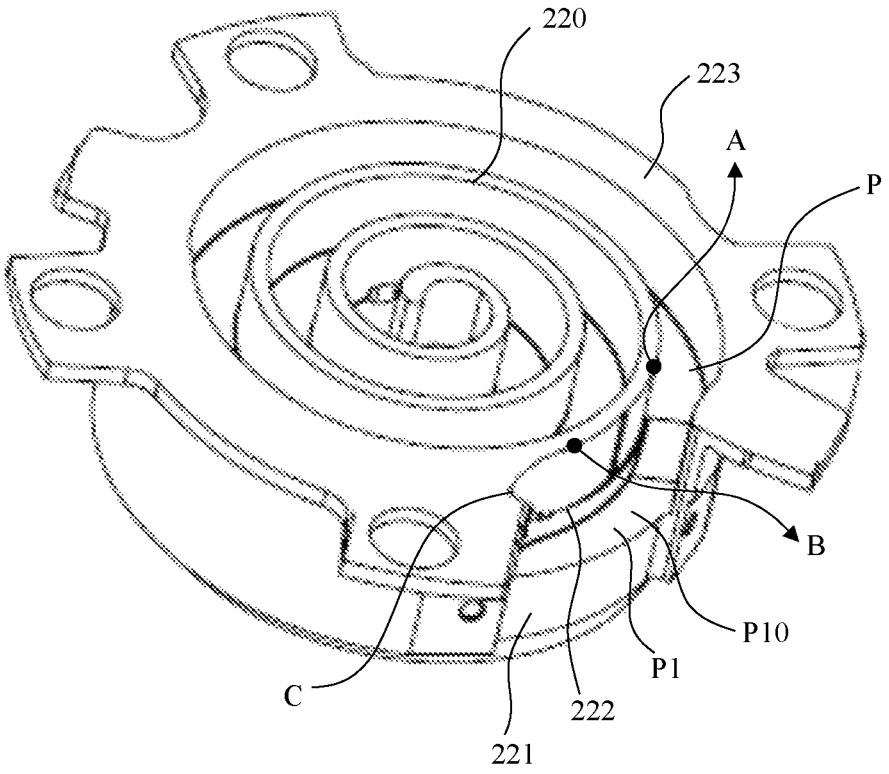
FIG. 5 is a perspective view of the non-orbiting scroll according to a second embodiment of the present application.
Figure 6:
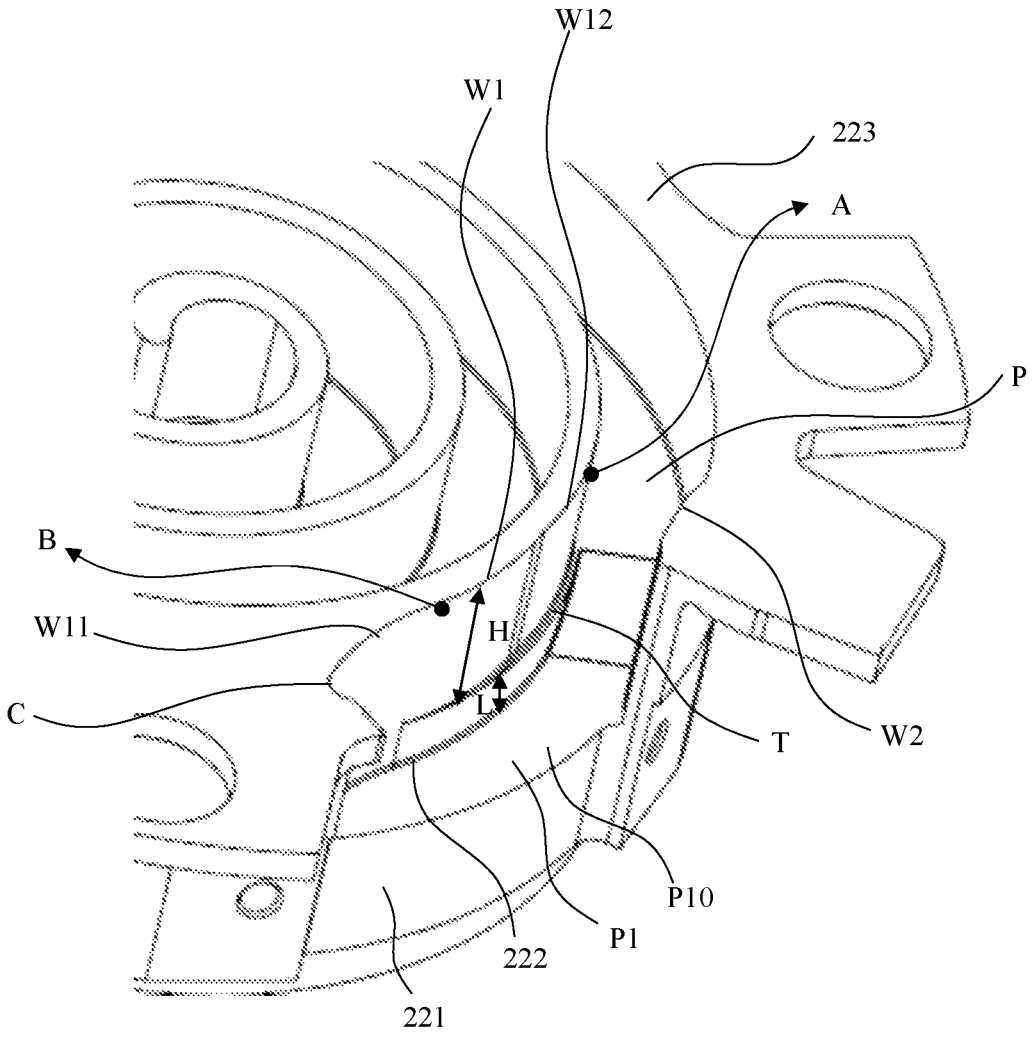
FIG. 6 is a partial enlarged view of the non-orbiting scroll in FIG. 5.
Figure 7:
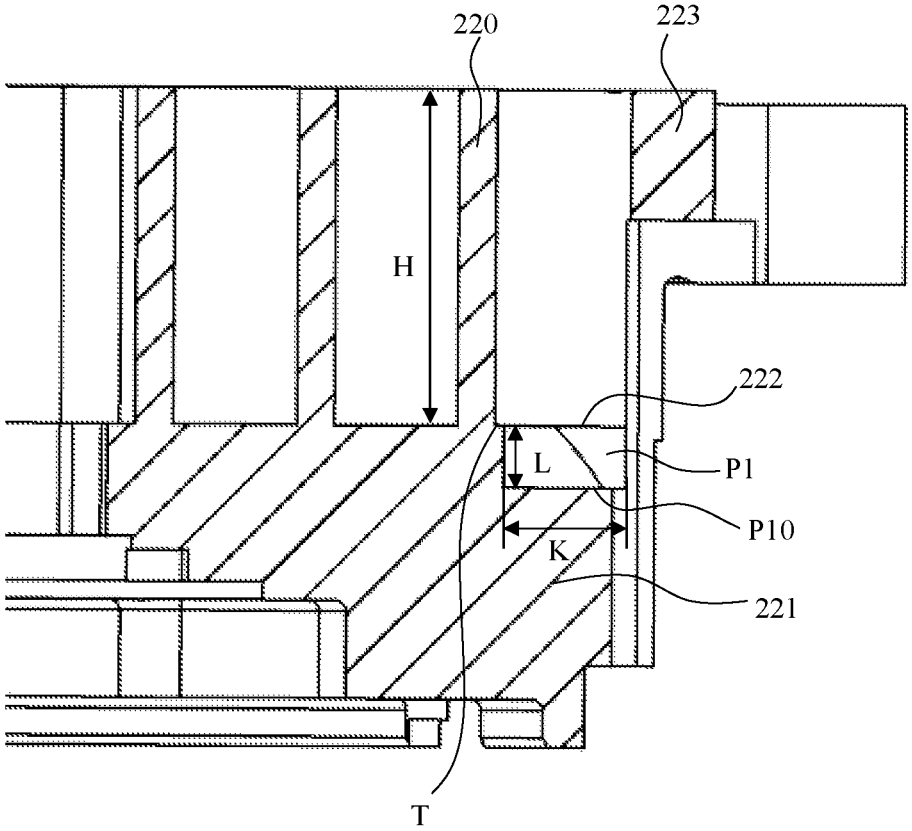
FIG. 7 is a partial longitudinal cross-sectional view of the non-orbiting scroll in FIG. 5.

FIG. 5 is a perspective view of the non-orbiting scroll 22 according to the second embodiment; FIG. 6 is a partial enlarged view of the non-orbiting scroll 22 in FIG. 5; FIG. 7 is a partial longitudinal cross-sectional view of the non-orbiting scroll 22 in FIG. 5; and FIG. 8 is a partial longitudinal sectional view of the non-orbiting scroll 22 in FIG. 5 viewed from another perspective.

As shown in FIG. 5, in this embodiment, the air inlet S in the peripheral wall 223 of the non-orbiting scroll 22 has the configuration shown in FIG. 2*b* as described above, that is, there is no bridging portion above the air inlet S. Moreover, in this embodiment, the flow-guiding passage P has a streamlined design similar to that of the flow-guiding passage P in the above first embodiment in a radial direction of the non-orbiting scroll 22. The difference is that: in this embodiment, the flow-guiding passage P further includes a recessed portion P1 recessed relative to the first side surface 222 of the non-orbiting scroll end plate 221, the recessed portion P1 includes a recessed bottom wall P10, and a recessed depth L of the recessed bottom wall P10 relative to the first side surface 222 satisfies: $L \leq 0.3H$, where H is an axial height of the non-orbiting scroll wrap 220 (as best shown in FIG. 7), and preferably, the recessed depth L increases from the above-mentioned engagement position A toward the starting end C, so that the first section W11 extending from the starting end C has relatively larger axial space for receiving more refrigerant, so as to ease the impact of the refrigerant when entering the flow-guiding passage P, and the recessed depth L gradually decreases from point B to the engagement position A, which can smoothly guide the refrigerant into the subsequent suction cavity, and is beneficial to reducing the formation of turbulence and vortex, and can reduce the pressure gradient of the refrigerant in different areas of the flow-guiding passage P.

Preferably, in this embodiment, the recessed portion P1 extends along a full length of the flow-guiding passage P, that is, extends form the starting end C to the engagement position A. However, the present application is not limited thereto, and corresponding adjustments can be made according to the actual application requirements. For example, the recessed portion P1 can extend from the starting end C to ¾ length, ½ length, ⅓ length of the flow-guiding passage P, and can be flexibly selected.

Figure 8:
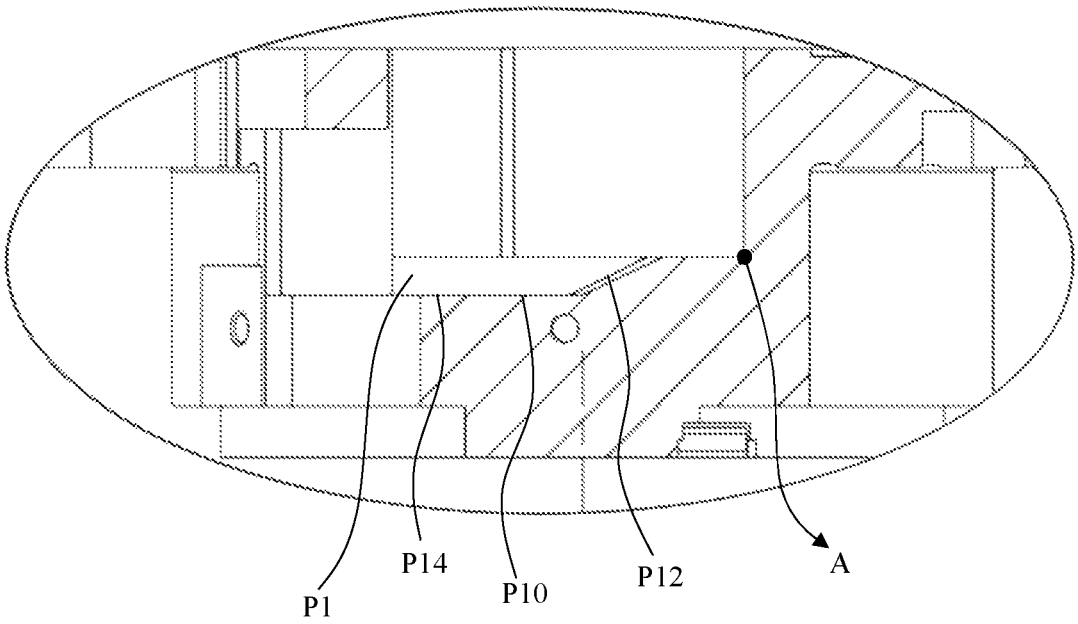
FIG. 8 is a partial longitudinal cross-sectional view of the non-orbiting scroll in FIG. 5 viewed from another perspective.

In addition, as best shown in FIG. 6 and FIG. 8, the recessed bottom wall P10 includes an inclined surface section P12 extending from the engagement position A and a remaining flat surface section P14 extending to the starting end C. The respective lengths of the inclined surface section P12 and the flat surface section P14 can be adjusted according to the actual application requirements, as long as the formation of turbulence and vortex can be reduced and the pressure gradient of the refrigerant in different areas of the flow-guiding passage P can be reduced, for example, the recessed bottom wall P10 can also only include the inclined surface section extending from the starting end C to the engagement position A, without including the flat surface section, or, the recessed bottom wall P10 can also include a curved surface or various possible combinations of a curved surface and an inclined surface or a horizontal surface.

Further, in order to better adjust the flow-guiding effect of the flow-guiding passage P on the refrigerant, a value of a third radial width K of the recessed bottom wall P10 of the recessed portion P1 can be specially designed to preferably satisfy: $0.7Xm \leq K \leq Xm$, where Xm represents the above first radial width. In addition, considering that if the second radial width X of the flow-guiding passage P described in the first embodiment is also smaller than the first radial width Xm, it can be further arranged that the third radial width K of at least a part of the recessed portion P1 is smaller than the corresponding second radial width X at the same position along the non-orbiting scroll wrap 220, to form a step portion T on the first side surface 222 of the non-orbiting scroll end plate 221 (as best shown in FIG. 7). The corresponding step portion T is also shown in FIG. 6. The step portion T in the figure is located on a side of the first side wall W1, and extends from the engagement portion A to a section of the first side wall W1 and gradually narrows without extending to the starting end C. The third radial width K and the corresponding step portion T can be flexibly adjusted according to the actual application requirements, and it should be understood that the step portion T can also be located on a side of the second side wall W2.

In addition, for the recessed bottom wall P10, it is preferable to control a recessed angle G formed relative to the first side surface 222 of the non-orbiting scroll end plate 221, that is, it is preferable to set the recessed angle G less than or equal to 70°, that is, the recessed angles G formed by portions of the recessed bottom wall P10 relative to the first side surface 222 are less than or equal to 70°, so as to control the formation of turbulence and vortex, and adjust the pressure gradient of the refrigerant at each place.

It should be understood that although in the above second embodiment, the design of the recessed portion P1 is combined with the streamline design of the flow-guiding passage P disclosed in the first embodiment, the present application is not limited thereto. In some cases, the design of the recessed portion P1 disclosed in the second embodiment can be completely applied independently, and can also achieve the technical effect of reducing the formation of turbulence and vortex and reducing the pressure gradient of the refrigerant in different areas to a certain extent.

Other further modifications according to the present application are described below in conjunction with FIGS. 9 to 11.

Figure 9:
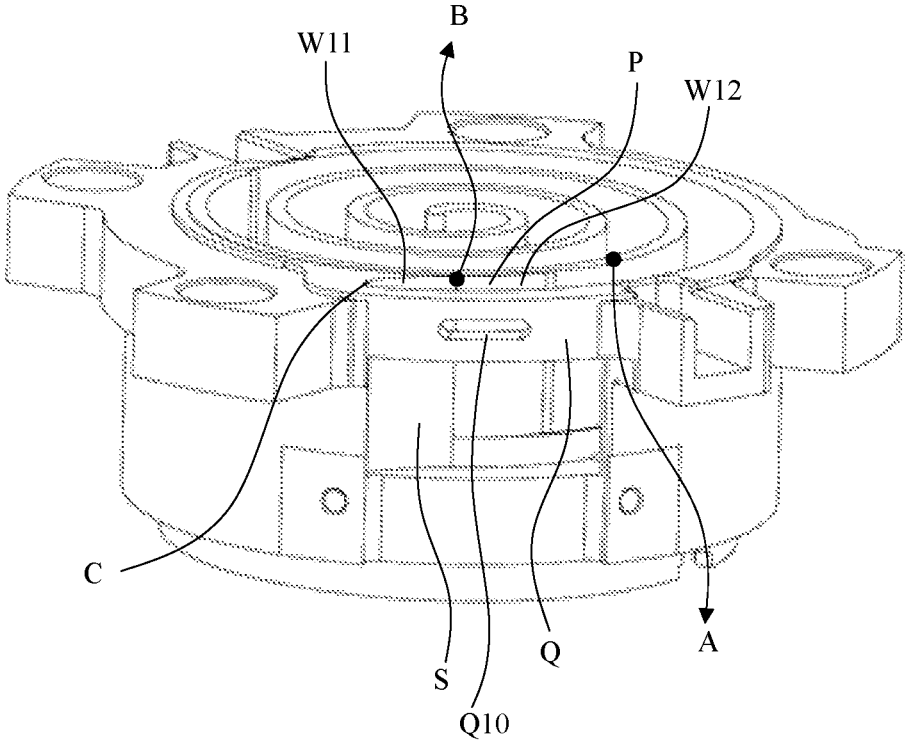
FIG. 9 is a perspective view of the non-orbiting scroll according to a third embodiment of the present application.

FIG. 9 is a perspective view of the non-orbiting scroll 22 according to a third embodiment of the present application.

This embodiment is a further improvement based on the combination of the streamline design of the flow-guiding passage P described in the first embodiment and the design of the recessed portion P1 described in the second embodiment. As shown in FIG. 9, in this embodiment, the air inlet S in the peripheral wall 223 has the configuration in FIG. 2*c* as described above, and the bridging portion Q above the air inlet S is shown in FIG. 9. The improvement of this embodiment mainly lies in that: a long ventilation opening Q10 is defined in the bridging portion Q, so that a part of the refrigerant can enter into the flow-guiding passage P through the ventilation opening Q10. The branched flow path can disperse the possible turbulence or vortex in the flow-guiding passage P, balance the pressure gradient in areas of the flow-guiding passage P, and thus improve the refrigeration efficiency of the scroll compressor 1.

In addition, preferably, turbulence, vortex or pressure gradient are more likely to occur in the second section W12 of the flow-guiding passage P, so as shown in the figure, the ventilation opening Q10 can preferably be defined at the position corresponding to the second section W12 to better play its role.

Similarly, other forms of ventilation openings can be defined according to actual application requirements to achieve similar object. FIG. 10 is a perspective view of the non-orbiting scroll according to a fourth embodiment of the present application; and FIG. 11 is a perspective view of the non-orbiting scroll according to a fifth embodiment of the present application.

Figure 10:
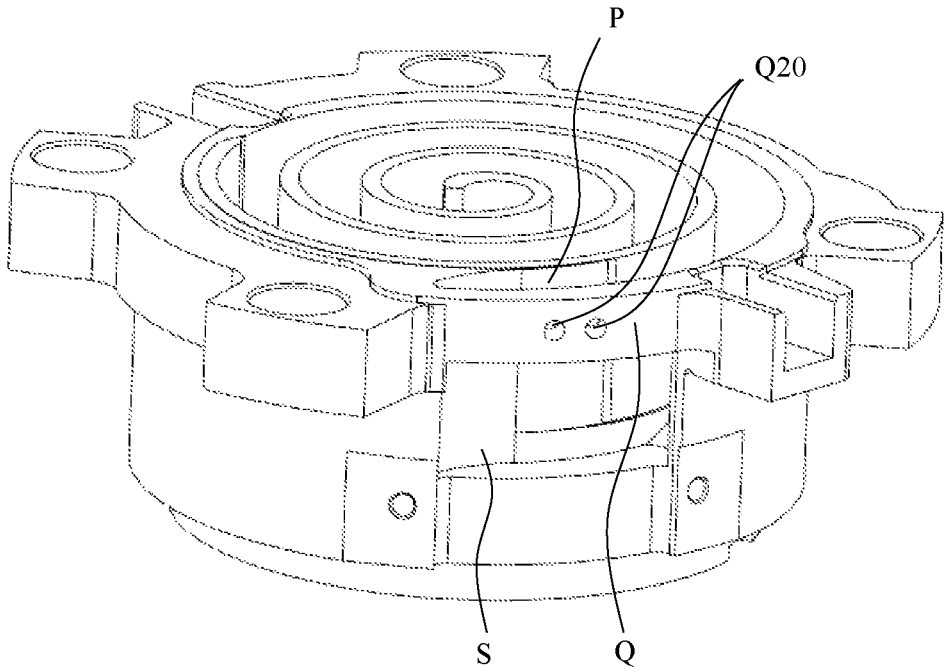
FIG. 10 is a perspective view of the non-orbiting scroll according to a fourth embodiment of the present application.

As shown in FIG. 10, two circular ventilation openings Q20 are used, and a distance between the two circular ventilation openings Q20 can be adjusted as required to achieve the best technical effect, and the number of ventilation openings Q20 can also be arranged as required.

Figure 11:
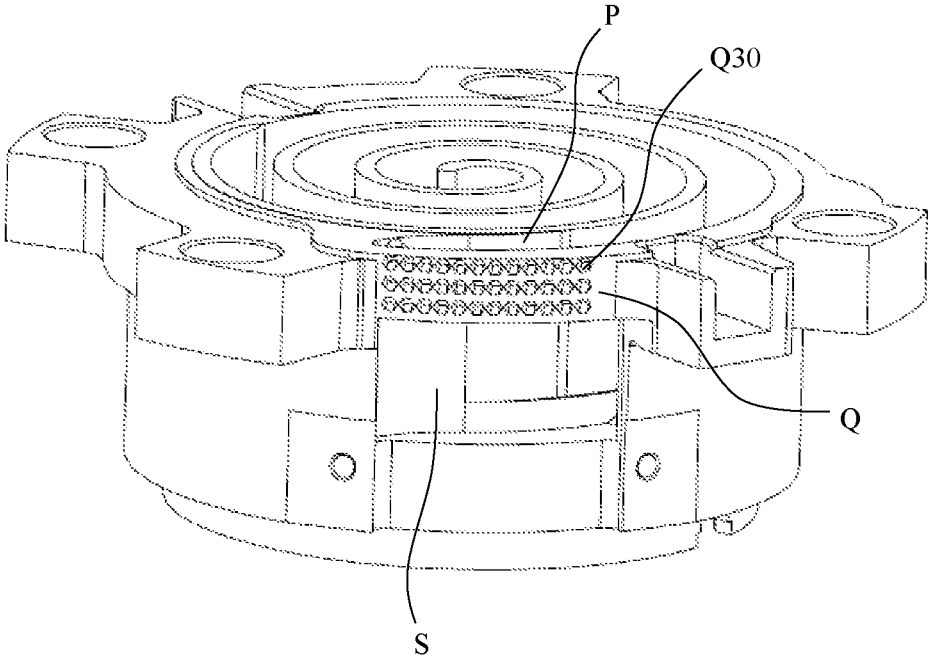
FIG. 11 is a perspective view of the non-orbiting scroll according to a fifth embodiment of the present application.

As shown in FIG. 11, rows of honeycomb-shaped ventilation openings Q30 can enable more refrigerant to flow into the flow-guiding passage P through the ventilation openings Q30, and these three rows of ventilation openings Q30 can also be positioned to correspond to the first section W11 and the second section W12 respectively as shown in the figure, which can be arranged according to requirements.

It should also be understood that such ventilation openings can also be similarly arranged in other parts of the peripheral wall 223 of the non-orbiting scroll 22 except for the bridging portion Q to achieve similar technical effects.

The design of this ventilation opening has a simple structure, and it can be processed into holes with various other shapes by various common methods such as drilling, milling, and 3D printing and drilling. In addition, this design can also be adopted independently, without in combination with the streamline design of the flow-guiding passage P described in the first embodiment and the design of the recessed portion P1 described in the second embodiment.

In order to better illustrate the beneficial technical effects of the present application, the inventor took the scroll compressor of 29 cc model as the research object and carried out the following comparative experiments: CFD comparative analysis was carried out with the scroll compressor using the non-orbiting scroll in the third embodiment of the present application and the scroll compressor using the non-orbiting scroll in the conventional technology. The results are shown in Table 1 below. The results show that: under the same working condition, the pressure loss at the air inlet of the scroll compressor using the non-orbiting scroll in the third embodiment of the present application can be reduced by 25.7% compared with the scroll compressor using the non-orbiting scroll in the conventional technology, which has fully verified the significant technical progress brought by the non-orbiting scroll and the scroll compressor according to the present application.

| 29 cc model | Medium | Rotation speed | Inlet | Outlet | Pressure drop of refrigerant | Enthalpy difference drop of refrigerant |
|---|---|---|---|---|---|---|
| Existing design | R410A | 7800 RPM | 198 g/s | 1443 kpa | 21.0 kpa | / |
| Optimized design | R410A | 7800 RPM | 198 g/s | 1443 kpa | 15.6 kpa | −25.7% |

Apparently, various implementations can be further designed by combining or modifying different embodiments and each technical feature in different ways.

The non-orbiting scroll and the scroll compressor according to the preferred embodiment of the present application are described above in conjunction with the specific implementations. It can be understood that, the above description is merely exemplary rather than restrictive, and those skilled in the art can conceive various variations and modifications without departing from the scope of the present application with reference to the above description. These variations and modifications shall still fall in the protection scope of the present application.

The invention claimed is:

1. A non-orbiting scroll of a scroll compressor, comprising:

a non-orbiting scroll end plate;

a non-orbiting scroll wrap extending from a first side surface of the non-orbiting scroll end plate; and a peripheral wall extending from the first side surface, located radially outside the non-orbiting scroll wrap and surrounding the non-orbiting scroll wrap, wherein an air inlet is provided in the peripheral wall, wherein the non-orbiting scroll wrap comprises a starting end connected to the peripheral wall and an engagement position to be engaged with a radial outermost tail end of an orbiting scroll wrap of an orbiting scroll of the scroll compressor, and the non-orbiting scroll wrap comprises a wrap section extending from the starting end to the engagement position, wherein the non-orbiting scroll further comprises a flow-guiding passage in fluid communication with the air inlet, the flow-guiding passage extends from the starting end and extends along at least a part of the wrap section, the wrap section comprises a first side wall located in the flow-guiding passage, the first side wall comprises a first section extending from the starting end and having a first curvature center and a second section extending from the first section and having a second curvature center, and the first curvature center and the second curvature center are respectively located on radially opposite sides of the first side wall; and wherein the first section extends from the starting end to ⅕ to ⅔ of a length of the first side wall, and a curvature change value of the first section is larger than a curvature change value of the second section.

2. The non-orbiting scroll according to claim 1, wherein in the flow-guiding passage, a largest curvature is defined at the starting end.

3. The non-orbiting scroll according to claim 1, wherein a distance between the peripheral wall and the non-orbiting scroll wrap at the engagement position is a first radial width Xm, the starting end is formed as a filleted corner, and a radius of curvature Rc of the filleted corner satisfies: 2 mm≤Rc≤0.4Xm.

4. The non-orbiting scroll according to claim 1, wherein along a direction from the engagement position to the starting end, a first radial thickness of a flow-guiding wrap section, defining the flow-guiding passage, of the wrap section increases progressively, and the first radial thickness is larger than or equal to a second radial thickness of the non-orbiting scroll wrap at the engagement position and is smaller than or equal to 3 times of the second radial thickness.

5. The non-orbiting scroll according to claim 1, wherein the flow-guiding passage comprises a recessed portion recessed relative to the first side surface, the recessed portion comprises a recessed bottom wall, and a recessed depth L of the recessed bottom wall relative to the first side surface satisfies: L≤0.3H, wherein H is an axial height of the non-orbiting scroll wrap.

6. The non-orbiting scroll according to claim 5, wherein the recessed depth increases toward the starting end.

7. The non-orbiting scroll according to claim 5, wherein the recessed bottom wall comprises an inclined surface, a horizontal surface, a curved surface or a combination thereof.

8. The non-orbiting scroll according to claim 5, wherein a distance between the peripheral wall and the non-orbiting scroll wrap at the engagement position is a first radial width Xm, a third radial width K of the recessed portion satisfies: $0.7Xm \leq K < Xm$, the flow-guiding passage has a second radial width, the third radial width of at least a part of the recessed portion is smaller than the second radial width of the flow-guiding passage at a corresponding position along an extending direction of the non-orbiting scroll wrap to form a step portion on the first side surface.

9. The non-orbiting scroll according to claim 5, wherein a recessed angle of the recessed bottom wall relative to the first side surface is less than or equal to 70°.

10. The non-orbiting scroll according to claim 1, wherein at least one ventilation opening is provided in the peripheral wall, so that refrigerant can enter the flow-guiding passage through the at least one ventilation opening.

11. The non-orbiting scroll according to claim 10, wherein the peripheral wall comprises a bridging portion located at an axial tail end of the peripheral wall and adjacent to the air inlet, and the at least one ventilation opening is provided at the bridging portion.

12. The non-orbiting scroll according to claim 1, wherein a circumferential side of the air inlet is substantially flush with the starting end.

13. A scroll compressor, comprising the non-orbiting scroll according to claim 1.

14. A non-orbiting scroll of a scroll compressor, comprising:

a non-orbiting scroll end plate;

a non-orbiting scroll wrap extending from a first side surface of the non-orbiting scroll end plate; and a peripheral wall extending from the first side surface, located radially outside the non-orbiting scroll wrap and surrounding the non-orbiting scroll wrap, wherein an air inlet is provided in the peripheral wall, wherein the non-orbiting scroll wrap comprises a starting end connected to the peripheral wall and an engagement position to be engaged with a radial outermost tail end of an orbiting scroll wrap of an orbiting scroll of the scroll compressor, and the non-orbiting scroll wrap comprises a wrap section extending from the starting end to the engagement position, wherein the non-orbiting scroll further comprises a flow-guiding passage in fluid communication with the air inlet, the flow-guiding passage extends from the starting end and extends along at least a part of the wrap section, the wrap section comprises a first side wall located in the flow-guiding passage, the first side wall comprises a first section extending from the starting end and having a first curvature center and a second section extending from the first section and having a second curvature center, and the first curvature center and the second curvature center are respectively located on radially opposite sides of the first side wall, and wherein a distance between the peripheral wall and the non-orbiting scroll wrap at the engagement position is a first radial width Xm, the starting end is formed as a filleted corner, and a radius of curvature Rc of the filleted corner satisfies: $2\ mm \leq Rc \leq 0.4Xm$.

15. A non-orbiting scroll of a scroll compressor, comprising:

a non-orbiting scroll end plate;

a non-orbiting scroll wrap extending from a first side surface of the non-orbiting scroll end plate; and a peripheral wall extending from the first side surface, located radially outside the non-orbiting scroll wrap and surrounding the non-orbiting scroll wrap, wherein an air inlet is provided in the peripheral wall, wherein the non-orbiting scroll wrap comprises a starting end connected to the peripheral wall and an engagement position to be engaged with a radial outermost tail end of an orbiting scroll wrap of an orbiting scroll of the scroll compressor, and the non-orbiting scroll wrap comprises a wrap section extending from the starting end to the engagement position, wherein the non-orbiting scroll further comprises a flow-guiding passage in fluid communication with the air inlet, the flow-guiding passage extends from the starting end and extends along at least a part of the wrap section, the wrap section comprises a first side wall located in the flow-guiding passage, the first side wall comprises a first section extending from the starting end and having a first curvature center and a second section extending from the first section and having a second curvature center, and the first curvature center and the second curvature center are respectively located on radially opposite sides of the first side wall, wherein the flow-guiding passage comprises a recessed portion recessed relative to the first side surface, the recessed portion comprises a recessed bottom wall, and a recessed depth L of the recessed bottom wall relative to the first side surface satisfies: $L \leq 0.3H$, wherein H is an axial height of the non-orbiting scroll wrap.

16. The non-orbiting scroll according to claim 15, wherein the recessed depth increases toward the starting end.

17. The non-orbiting scroll according to claim 15, wherein the recessed bottom wall comprises an inclined surface, a horizontal surface, a curved surface or a combination thereof.

18. The non-orbiting scroll according to claim 15, wherein a distance between the peripheral wall and the non-orbiting scroll wrap at the engagement position is a first radial width Xm, a third radial width K of the recessed portion satisfies: $0.7Xm \leq K < Xm$, the flow-guiding passage has a second radial width, the third radial width of at least a part of the recessed portion is smaller than the second radial width of the flow-guiding passage at a corresponding position along an extending direction of the non-orbiting scroll wrap to form a step portion on the first side surface.

19. The non-orbiting scroll according to claim 15, wherein a recessed angle of the recessed bottom wall relative to the first side surface is less than or equal to 70°.

* * * * *